US006786496B2

(12) United States Patent
Ward et al.

(10) Patent No.: US 6,786,496 B2
(45) Date of Patent: Sep. 7, 2004

(54) SECURITY WHEELCHAIR

(75) Inventors: Gary Ward, 3611 Rosedale Ave., Dallas, TX (US) 75205-1227; John Lonczak, Newburgh, NY (US)

(73) Assignee: Gary Ward, Dallas, TX (US)

( * ) Notice: Subject to any disclaimer, the term of this patent is extended or adjusted under 35 U.S.C. 154(b) by 0 days.

(21) Appl. No.: 10/285,796

(22) Filed: Oct. 31, 2002

(65) Prior Publication Data

US 2004/0084870 A1 May 6, 2004

(51) Int. Cl.[7] ..... A61G 5/00

(52) U.S. Cl. ..... 280/250.1; 280/304.1; 297/423.25

(58) Field of Search ..... 280/250.1, 304.1; 297/DIG. 2, DIG. 4, 148, 153, 228.1, 283.2, 423.25, 423.26, 423.29, 451.13, 452.14, 452.56, 228.13

(56) References Cited

U.S. PATENT DOCUMENTS

| | | | | | |
|---|---|---|---|---|---|
| 4,457,528 | A | * | 7/1984 | Ichikawa et al. | 280/250.1 |
| 4,457,535 | A | | 7/1984 | Takeuchi | 280/650 |
| 4,489,955 | A | * | 12/1984 | Hamilton | 280/250.1 |
| 4,598,921 | A | * | 7/1986 | Fenwick | 280/250.1 |
| D294,475 | S | * | 3/1988 | Chen | D12/131 |
| 4,770,432 | A | | 9/1988 | Wagner | 280/342 |
| 4,805,931 | A | | 2/1989 | Slasor | 280/650 |
| 4,917,395 | A | | 4/1990 | Gabriele | 280/250 |
| 5,028,065 | A | | 7/1991 | Danecker | 280/250 |
| D321,335 | S | * | 11/1991 | Aoki et al. | D12/131 |
| 5,076,602 | A | | 12/1991 | Robertson | 280/304 |
| 5,116,067 | A | * | 5/1992 | Johnson | 280/7.14 |
| 5,145,197 | A | | 9/1992 | Gatti | 280/304 |
| 5,152,543 | A | | 10/1992 | Sims | 280/250 |
| 5,230,524 | A | * | 7/1993 | Jackson | 280/47.38 |
| 5,253,888 | A | * | 10/1993 | Friedrich | 280/250.1 |
| 5,320,373 | A | | 6/1994 | Robertson | 280/250 |
| 5,360,224 | A | * | 11/1994 | Geiger et al. | 280/250.1 |
| 5,382,036 | A | * | 1/1995 | Counts et al. | 280/250.1 |
| 5,588,663 | A | * | 12/1996 | Rundle et al. | 280/304.1 |
| 5,603,520 | A | | 2/1997 | Pearce | 280/250 |
| 5,836,654 | A | | 11/1998 | DeBellis | 297/452 |
| 5,848,824 | A | | 12/1998 | Mocur | 297/440 |
| 5,884,928 | A | | 3/1999 | Papac | 280/250 |
| 6,276,704 | B1 | | 8/2001 | Suiter | 280/250 |

* cited by examiner

*Primary Examiner*—Anne Marie Boehler

(57) ABSTRACT

A barrier-free wheelchair constructed entirely of plastic or non-metal components. The device is designed to facilitate the passage of wheelchair occupants through magnetometers, such as those utilized for airport security. The present invention is non-collapsible in nature, as the device is intended for on-site usage and not for transport in vehicles and the like. Due to its materials and construction, the wheelchair of the present invention also allows for a solid non-sling seat, is pilferage resistant, and provides multiple surfaces upon which indicia, such as corporate graphics, may appear. In addition, consistent with pre-existing wheelchairs, the present invention allows for the removable attachment of a variety of accessories, including foot rests and trays.

12 Claims, 6 Drawing Sheets

SECURITY WHEELCHAIR

BACKGROUND OF THE INVENTION

1. Field of the Invention

The present invention is a barrier-free wheelchair constructed entirely of non-metal components, such as plastic. The device is designed to facilitate the passage of wheelchair occupants through magnetometers, such as those utilized for security purposes in airports, government buildings, and a host of other locations.

The present invention is non-collapsible in nature, as the device may be for on-site usage and not for transport in vehicles and the like. Due to its materials and construction, the wheelchair of the present invention importantly allows for a solid, non-sling seat. Alternatively, a traditional sling-type seat may be utilized. The wheelchair is also pilferage resistant, and provides multiple surfaces upon which indicia, such as corporate graphics, may appear. In addition, consistent with pre-existing wheelchairs, the present invention allows for the removable attachment of a variety of accessories, including foot rests and trays.

2. Description of the Prior Art

Numerous innovations for wheelchair devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

U.S. Pat. No. 4,457,535, Invented by Takeuchi et al., Entitled "Wheelchair"

The patent to Takeuchi et al. describes a wheelchair including a pair of frames located on opposite sides of the wheelchair, each frame being provided with a drive wheel equipped with a hand ring, and a castor; a back rest and a leg rest each formed of a web of flexible material connecting the pair of frames together; yoke members pivotally connected at lower ends to base tubular members of the pair of frames and connected for relative pivotal movements at an intersection while being connected at upper ends to a pair of seat tubular members; a seat formed of a web of flexible material hung between the seat tubular members which are adapted to be maintained at opposite ends in pressing engagement with front post members and rear post members of the pair of frames which are kept in a spaced-apart condition to bring the back rest and leg rest to a taut condition, whereby the back rest, leg rest and seat can have their lengths adjusted to thereby adjust the width of the wheelchair to a desired value.

U.S. Pat. No. 4,770,432, Invented by Wagner, Entitled "Wheelchair"

The Wagner invention describes a wheelchair construction particularly adaptable for collapsible wheelchairs and which may be formed of all nonmagnetic material, wherein the major components are skinned polymeric foam wheels and panels. The seat and back panels are hingedly supported on side panels, wherein the back panels include a downwardly opening V-shaped channel adjacent the center hinge which receives the upwardly foldable seat panels as the wheelchair is collapsed and the seat panels are supported in an overcenter hinge position on transverse foldable panels. The side panels include openings at their upper rearward corners forming integral C-shaped handles and the footrests are supported in a horizontal use or angled non-use position in configured slots formed in a support block.

U.S. Pat. No. 4,917,395, Invented by Gabriele, Entitled "Wheelchair And Method Of Making Same"

The wheelchair of the Gabriele invention is made of a non-metallic material. The wheelchair is made so that it is easily assembled, light weight and less expensive than traditional wheelchairs. The wheelchair employs a unique hinge assembly which provides support for the seat, back and foot rest. By using the hinge assembly, the seat, back and foot rest are self-supporting because the hinge assembly distributes the forces acting upon these members through the side panels. The hinge members are molded integrally with the seat, back and foot panels. Further, when the side panel of the wheelchair is formed, slots are formed therein for receipt of the hinge member. The same is true of the foot rest. The present invention also employs an improved adjusting mechanism for adjusting the pivotal relationship of the foot rest and an improved brake assembly.

U.S. Pat. No. 5,152,543, Invented by Sims et al., Entitled "Composite Frame Wheelchair"

The patent to Sims describes an improved wheelchair constructed with a base frame formed from composite material tubing. The base frame comprises a pair of unitary side frames of composite material tubing which preferably has an elliptical cross section oriented to provide increased structural strength along a primary loading axis during normal use. The side frames are interconnected by a plurality of cross braces of composite material tubing, wherein the lengths of the cross braces can be selected in accordance with a desired wheelchair frame width. A folding seatback is mounted on the side frames for releasable locking in an upright orientation, with a pair of spring-loaded lock pins being releasable by pulling a pull cord to permit seatback folding to a collapsed condition.

U.S. Pat. No. 5,884,928, Invented by Papac, Entitled "Wheelchair"

The patent to Papac describes a wheelchair having a chassis formed of flat plate which is folded to define a lower chassis, a chassis back, and an upper chassis. The lower and the upper chassis each have a pair of elongated substantially parallel arms that extend from respective land portions of the chassis. The arms define openings in distal portions for receiving caster wheels. Drive wheels connect to axle mounts that are selectively positioned for track, camber, and height, which axle mounts connect to the chassis back. A seat support attaches to the chassis for supporting a person in the wheelchair and includes independently adjustable height, longitudinal position relative a seat back, and angle. A pair of push handles attach to the chassis back and pivotally connect to the seat support for selective positioning of the angle of the back.

U.S. Pat. No. 5,320,373, Invented Robertson et al., Entitled "Molded-Composite Chassis for a Wheelchair"

In the patent to Robertson et al., provided is a chassis having two longitudinal sides, one or more cross-bars between the sides, and two torsion forwardly and downwardly extending arms terminating in sleeves for holding snap-in casters. When attached to the other wheelchair components, the arms create a space therebetween and under the wheelchair seat for storage of optional items. The molded chassis may be tailored to performance specifications and is constructed from composite material, preferably by compression molding using sheet molding compound or by resin transfer molding. Shock and vibration attenuating characteristics are selectable and the chassis sides may be of one or multiple piece construction. Each longitudinal side includes two vertically extending posts for attaching a seat, the posts providing a height, seat pan angle and center of gravity adjustment mechanism for the seating system relative to the chassis. The drive wheels are attached to camber plugs which are secured within recesses in the sides. The camber plugs are interchangeable and include a variety of selected camber angles. In another aspect of the present invention, the crossbars are of adjustable width thereby permitting the width of the chassis to be adjusted to accommodate users of different sizes, and to accommodate different sized seating systems. In an additional aspect of the invention, the chassis disassembles into two halves, the two halves connected by cross-bars of a preselected length. In one additional aspect, seat mounting rails are attached within an inner surface of the longitudinal sides. The chassis may attach a variety of seating systems, including one piece composite seats.

U.S. Pat. No. 4,805,931, Invented by Slasor, Entitled "Lightweight Foldable Wheelchair"

The patent to Slasor describes a foldable wheelchair having opposed main side frames each comprising front and rear members supported on respective front and rear wheels and connected by upper and lower cross members, and a back member mounted for folding movement relative to the rear member wherein the side frames are connected by first and second foldable links for maintaining the side frames spaced apart in the erected condition of the wheelchair in which the back members are aligned with the rear members and support a flexible back panel, and the wheelchair is collapsible to a compact folded condition by folding the links to move the side frames adjacent to each other and by folding the back members to extend downwardly adjacent to the rear members and the associated rear wheels.

U.S. Pat. No. 5,603,520, Invented by Pearce, Entitled "Light-Weight Wheel Assembly For Wheelchairs"

In the patent to Pearce, a lightweight wheel assembly intended primarily for use on wheelchairs is disclosed and claimed. The assembly includes an injection-moldable fiber-reinforced plastic push rim comprising a variety of fastening devices. Important advantages of the invention include very light weight compared to prior art wheel assemblies while achieving the high component strength desired, shock absorption qualities beneficial to wheelchair users not provided by other wheel assemblies, and components which may be made from the inexpensive injection molding process.

U.S. Pat. No. 5,028,065, Invented by Danecker, Entitled "Wheelchair"

In the Danecker invention, in order to produce a much simpler and in particular lighter-weight wheel-chair than existing models, and to achieve at the same time optimum rigidity and safety, the surface of the seat, back support and side-walls are designed as a self-supporting monocoque construction, in self-reinforced and/or foam plastic. The base carried by the wheels also consists of self-reinforcing and/or foam plastic. The monocoque construction and base are integrally formed and have a height adjustment feature.

Additional relevant patents include U.S. Pat. No. 6,276,704, Invented by Suiter, titled "Adjustable Wheelchair Having A Tilting And Reclining Seat"; U.S. Pat. No. 5,145,197, invented by Gatti, titled "Folding Wheelchair With Rigid Seat"; U.S. Pat. No. 5,836,654, invented by DeBellis, titled "Wheelchair Seat Assembly With Contoured Seat Pan And Cushion And Method"; U.S. Pat. No. 5,076,602, invented by Robertson, titled "Seating System For A Wheel Chair"; and U.S. Pat. No. 5,848,824, invented by Mocur, titled "Wheelchair Seat And Backrest Construction." Such patents largely cover rigid seats used in conjunction with traditional collapsible wheelchairs, or otherwise illustrate additional non-sling type seats upon wheelchairs constructed of typical magnetic materials.

In contrast to the above, as noted herein, the present invention is a wheelchair constructed entirely of plastic or non-metal components, designed to facilitate the passage of wheelchair occupants through magnetometers, such as those utilized for airport security or in buildings such as courthouses. Due to its alternative materials and construction, the present invention is non-collapsible in nature, which uniquely allows for usage of a solid seat, which is form-fitting in nature, comprising arm rests thereon. Importantly, a single-piece seat may form an integral part of the overall design, and may also further comprise a suspension means in the form of flex arms for shock absorption, if desired. As an alternative to the rigid seat, a traditional sling-type wheelchair seat may also be utilized.

Furthermore, as noted, the device is pilferage resistant, and provides multiple surfaces upon which indicia, such as corporate graphics, may appear. In addition, consistent with pre-existing wheelchairs, the present invention allows for the removable attachment of a variety of accessories, such as foot rests and trays.

In summation, unlike the above-outlined prior art, the present invention provides a non-metallic, non-collapsible security wheelchair which is barrier-free, and may include a rigid bucket-type seat that forms an integral part of the framework.

SUMMARY OF THE INVENTION

As noted, the present invention is a barrier-free wheelchair constructed entirely of plastic or non-metal components. The device is designed to facilitate the passage of wheelchair occupants through magnetometers, such as those utilized for security purposes in buildings, transportation hubs, and various stadiums and arenas.

The present invention is non-collapsible in nature, as the device is intended for on-site usage and not for transport in vehicles and the like. Due to its alternative materials and construction, the wheelchair of the present invention also allows for usage of a single-piece rigid seat, or traditional sling-type seat. Furthermore, the wheelchair is pilferage resistant, and provides multiple surfaces upon which indicia, such as corporate graphics, may appear. In addition, consistent with pre-existing wheelchairs, the present invention allows for the removable attachment of a variety of accessories, including foot rests and trays.

In light of the foregoing, it is generally an object of the present invention to provide a barrier-free wheelchair that allows for convenient passage through metal detectors in areas such as airports and transportation hubs, courts and government buildings, colleges, universities, and other schools, stadiums, arenas, and other event halls, controlled outdoor events, and MRI and other medical diagnostic equipment.

It is also an object of the invention to provide a device that is generally lightweight in nature, and subject to relatively low shipping costs.

It is a further object of the invention to provide a wheelchair of a simple design that, unlike the prior art, is non-collapsible in nature.

It is an additional object of the invention to provide a wheelchair in which a rigid, form-fitting, bucket-style seat is utilized for enhanced comfort and stability.

It is an object of the present invention to provide a device with a seat that may form an integral part of the framework of the wheelchair, creating a secure and durable design previously unattained.

It is also an object of the invention to provide a device that includes multiple surfaces upon which indicia, such as corporate advertising, may be placed.

It is a further object of the present invention to provide a device that is generally pilferage-resistant, due to its integrated form.

It is another object of the present invention to provide a device that may include removable accessories thereon, such as foot rests and trays for user convenience.

It is also an object of the present invention to provide a device that may include an effective suspension system with optimal shock absorption capability.

An additional object of the invention is to provide a device that may be conveniently washed, as the sleek design is void of apertures and corners that would hold moisture and be difficult to access.

It is also an object of the present invention to provide a device that does not include open cavities that may be used to hold weapons, thus increasing the security value and effectiveness of the design.

It is a further object of the invention to provide a device that utilizes fewer working parts than traditional wheelchairs of the prior art.

It is also an object of the present invention to provide a device that features an entirely symmetrical design.

Another object of the present invention is to provide a device that allows for ease in replacing parts, allowing for an increased lifespan of the wheelchair.

Finally, it is an object of the present invention to provide a device that may allow the user of the wheelchair to remain in his or her own wheelchair, rather than switching to an additional device for the purposes of transport.

The novel features which are considered characteristic for the invention are set forth in the claims. The invention itself, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

The security wheelchair (10) is constructed of generally lightweight, non-metallic materials, to accomplish the purposes outlined in the summary section herein. In the preferred mode of manufacture, the barrier-free wheelchair is constructed entirely of plastic components, and is symmetrical in configuration, creating a simple design with a sleek and modem appearance. Moreover, the security wheelchair of the present invention may be manufactured in a variety of sizes rendering the design available for children and adults.

Figure 1:
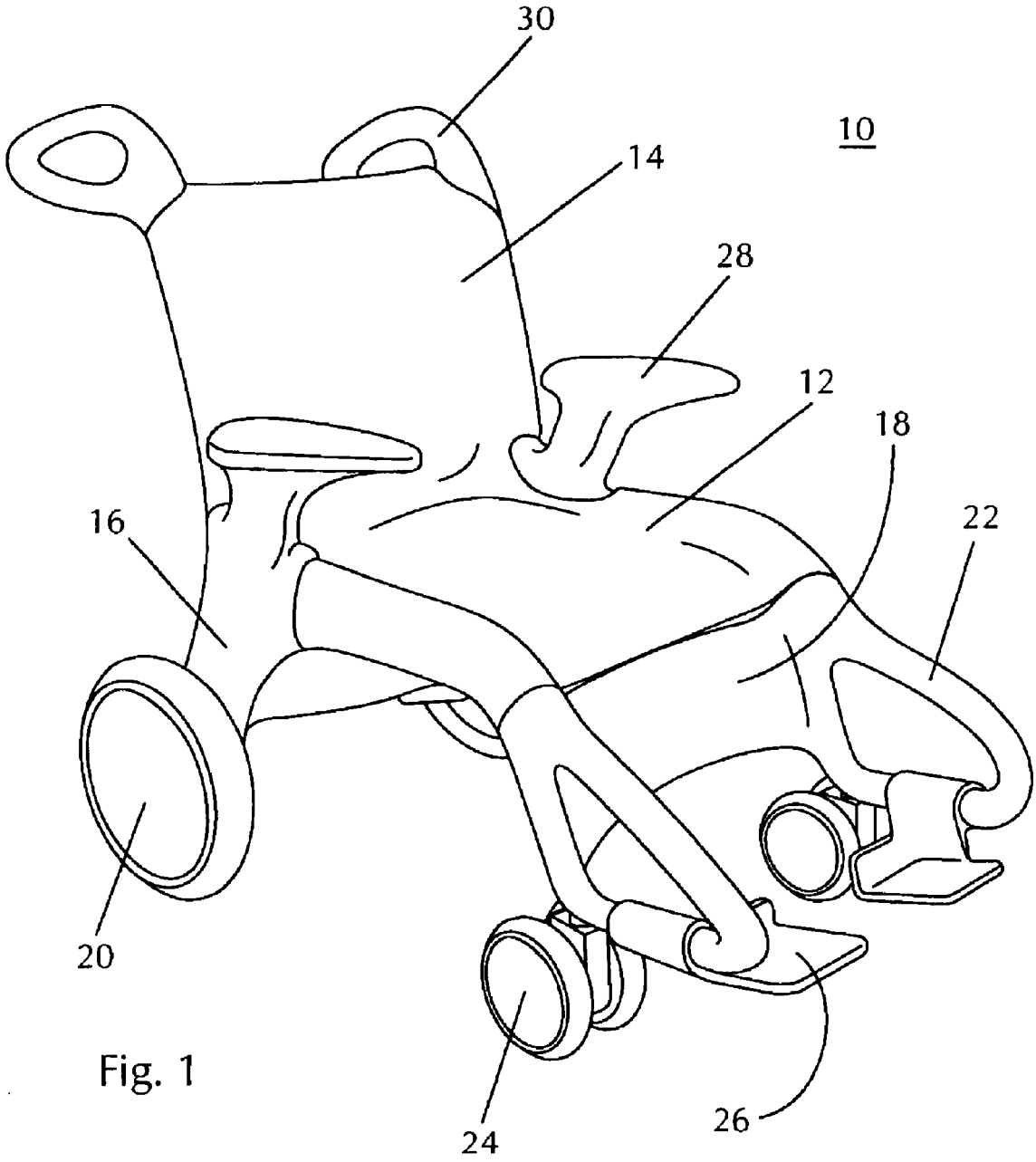
FIG. 1 is a front three quarter perspective view of the present invention, illustrating the principal components thereof in assembled form.

The wheelchair comprises a frame (16), which is of a smooth, integrated form that is intended to provide strength and stability while corresponding to the general contours of the body of the user. As shown in FIG. 1, the frame (16) comprises generally parallel left and right side horizontal members and a front support panel (18), which bridges the left and right side horizontal members along the front edge thereof. The front support panel (18) is thus located behind the legs of the user and functions to provide additional stability to the frame of the wheelchair.

Figure 2:
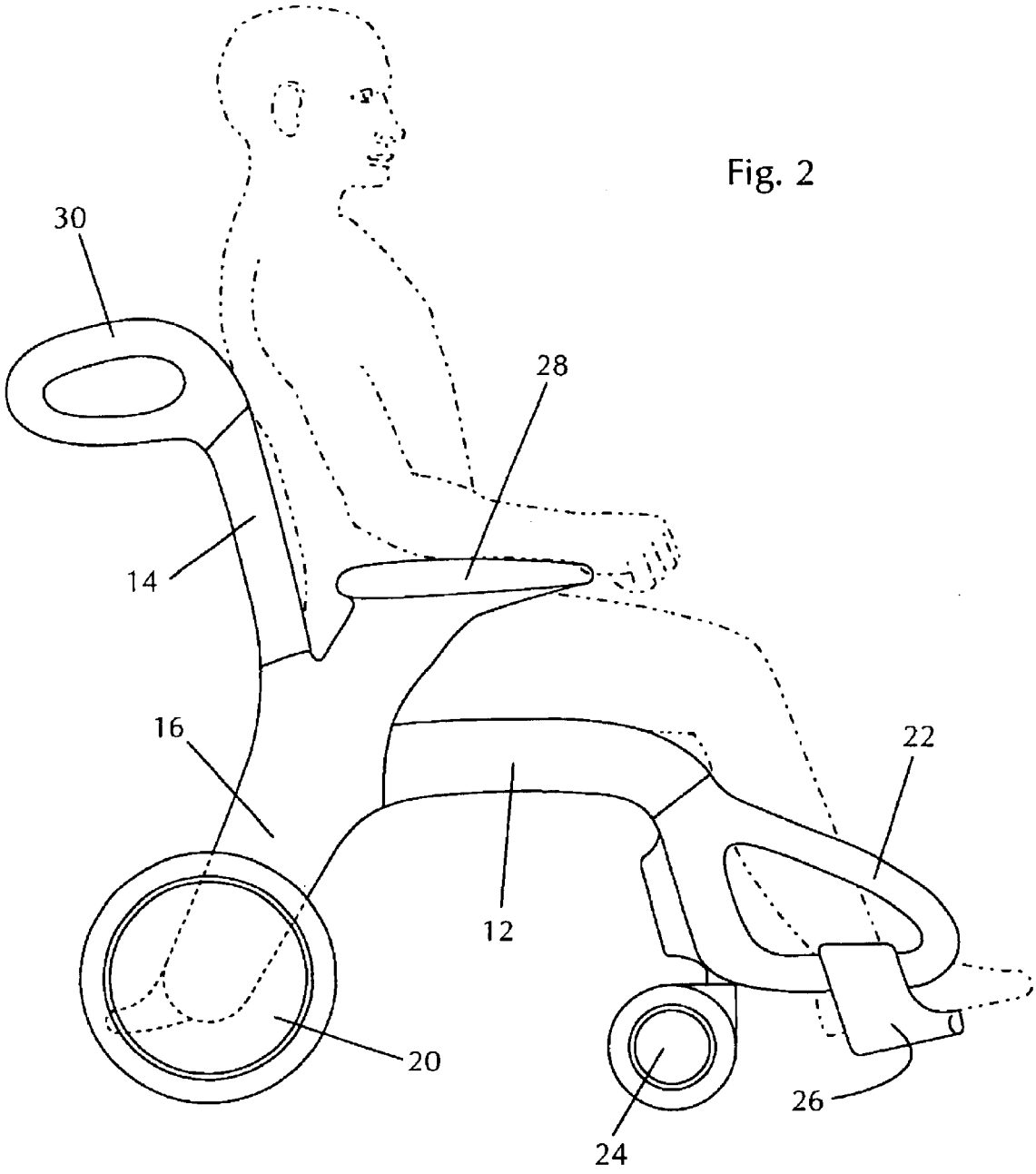
FIG. 2 is a front side view of the present invention, shown occupied by user.

In addition, left and right upper vertical members extend generally upwardly from a rear portion of the left and right side horizontal members of the frame. The left and right upper vertical members also extend slightly rearwardly, in an effort to provide stability to the overall design (as illustrated in FIG. 2).

Such left and right upper vertical members each comprise a handle (30) thereon for convenience of one pushing the wheelchair when occupied by the user. In the preferred mode of production, the handles (30) are manifested in an open or generally-looped curvature of the upper portion of the left and right upper vertical members, providing a simple, flowing design that is effective for its intended purpose (best shown in the side view of FIG. 2). Moreover, the handles (30) may comprise finger grips or texturing, as is commonly known in the art for the purpose of grip enhancement.

Figure 6:
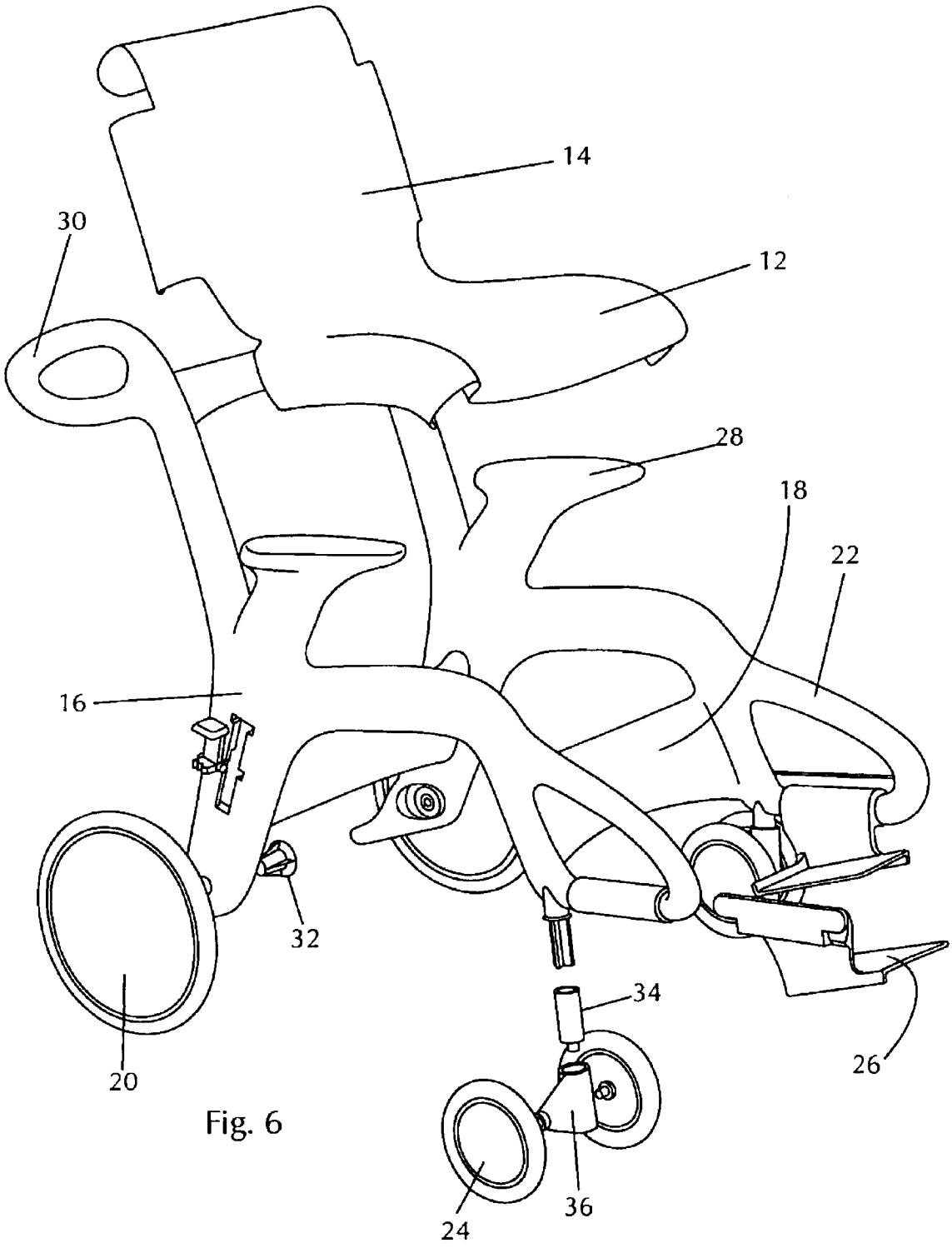
FIG. 6 is a front three-quarter exploded view of the contents of FIG. 1, illustrating the separate components that make up the present invention.

Furthermore, left and right lower vertical members extend generally downwardly from the rear portion of the left and right side horizontal members. The left and right lower vertical members also extend slightly rearwardly, in an effort to provide stability to the overall design (as illustrated in FIG. 2). As shown in FIG. 6, the left and right lower vertical members comprise brake levers on the sides thereof, functioning to allow the user to conveniently access the brake mechanism from the seated position. The user may pull the levers upwardly, functioning to engage rear wheel rings and lock the same in place, thus providing an effective braking means that does not require direct tire contact.

As also illustrated in FIG. 6, lower portions of such left and right lower vertical members comprise rear wheel bearings (32) thereon, which are located upon interior portions of such lower vertical members. Relatively large right and left wheels (20) are mounted to each of the wheel bearings (32), and such wheels are constructed of non-metallic materials to accomplish the unique purposes of the invention.

The frame (16) further comprises left and right arm rests (28) which extend upwardly from a previously-determined location of the left and right horizontal members. In the preferred mode of manufacture, the left and right armrests extend upwardly from a rear portion of the left and right horizontal members of the frame.

Importantly, in the preferred mode, a rigid, bucket-style seat is affixed to the left and right side horizontal members of the frame, which differs from sling-type seats commonly found in the prior art. Because the device of the present invention is non-collapsible and may be used on-site, such a sling-type seat need is not required. In such instance, the rigid seat of the present invention comprises a bottom portion (12) and back portion (14), and is molded in a form-fitting manner to provide previously unachieved levels of stability and comfort. A seat cushion (not illustrated in the FIGURES) may be removably attached to the seat of the wheelchair, if desired by the manufacturer or user. As noted herein, as an alternate to the rigid single-piece seat, a traditional sling-type seat may be utilized, if desired.

In addition, left and right front members (22) extend forwardly from the left and right side horizontal members and support panel (18). As illustrated in FIG. 6, the left and right front frame members (22) further comprise generally cylindrical sleeves (34) extending downwardly from front portions thereof, into which trucks (36) are inserted. Left and right front wheels (24) are affixed to each truck (36), and such wheels are of a smaller diameter than the rear wheels, to create the wheel configuration generally known in the art. In the preferred mode of manufacture, the wheelchair of the present invention utilizes two left front wheels and two right front wheels, each of the same diameter, to provide a secure structure that is relatively easy to push, turn, and maneuver.

Therefore, per the description contained in the summary section herein, the above structure functions to provide a non-collapsible wheelchair, constructed of non-metallic components, which may be passed through security systems and metal detection equipment without triggering same.

It is important to note that the wheelchair may comprise previously-determined colors, graphics, and indicia in a variety of locations thereon. Such may be for the purpose of general enhancement of appearance, or may be for the purpose of advertising or branding. For the purposes of example, the back portion of the seat (14) provides a particularly suitable location for the placement of corporate names, logos, tag-lines, or other text and graphics. Thus, in the instance in which the security wheelchair is utilized on-site at an airport terminal, the wheelchair may bear the corporate indicia of the particular airline used by the occupant.

Figure 3:
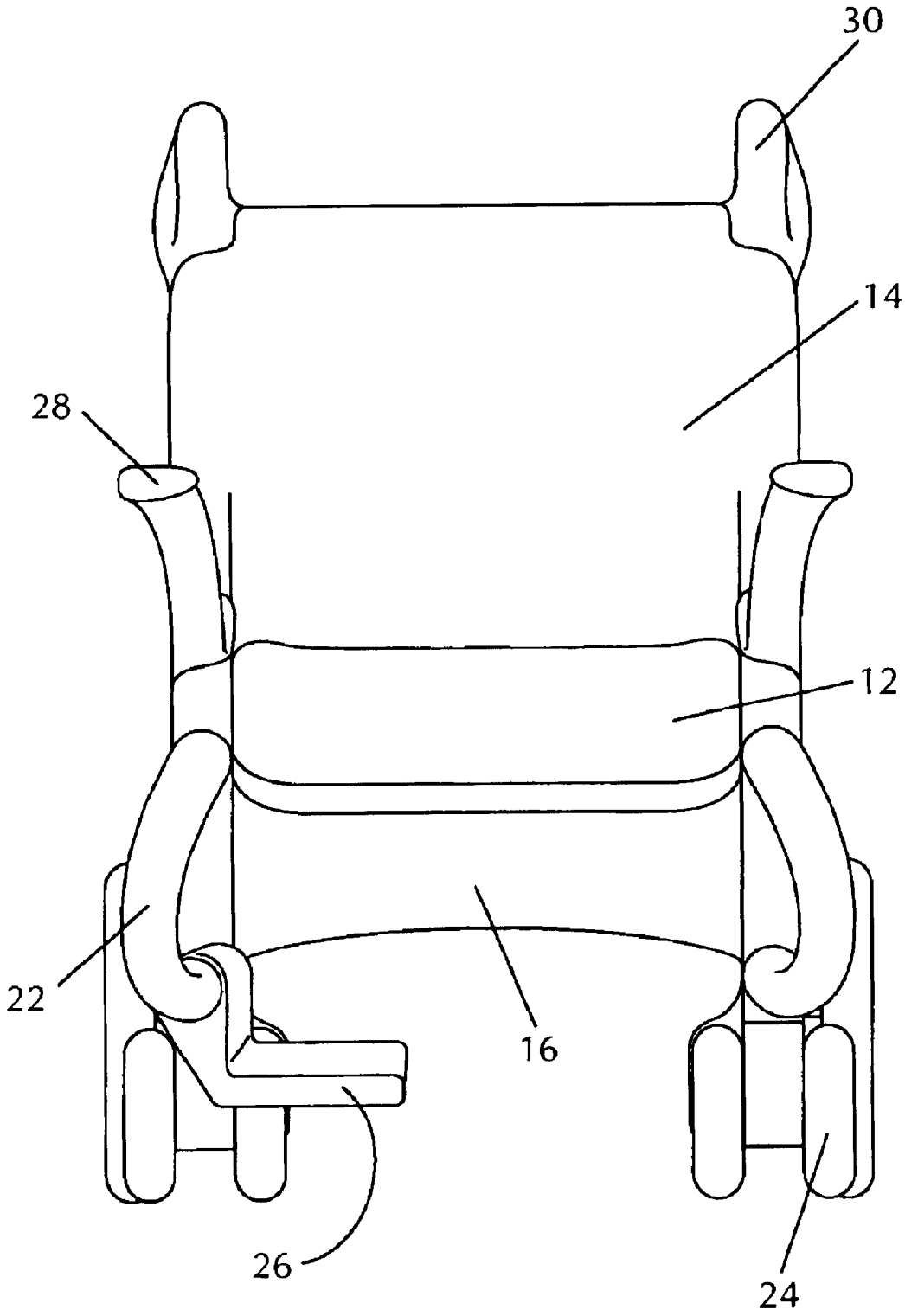
FIG. 3 is a front perspective view of the present invention, including foot rest, shown for the purposes of example only.
Figure 4:
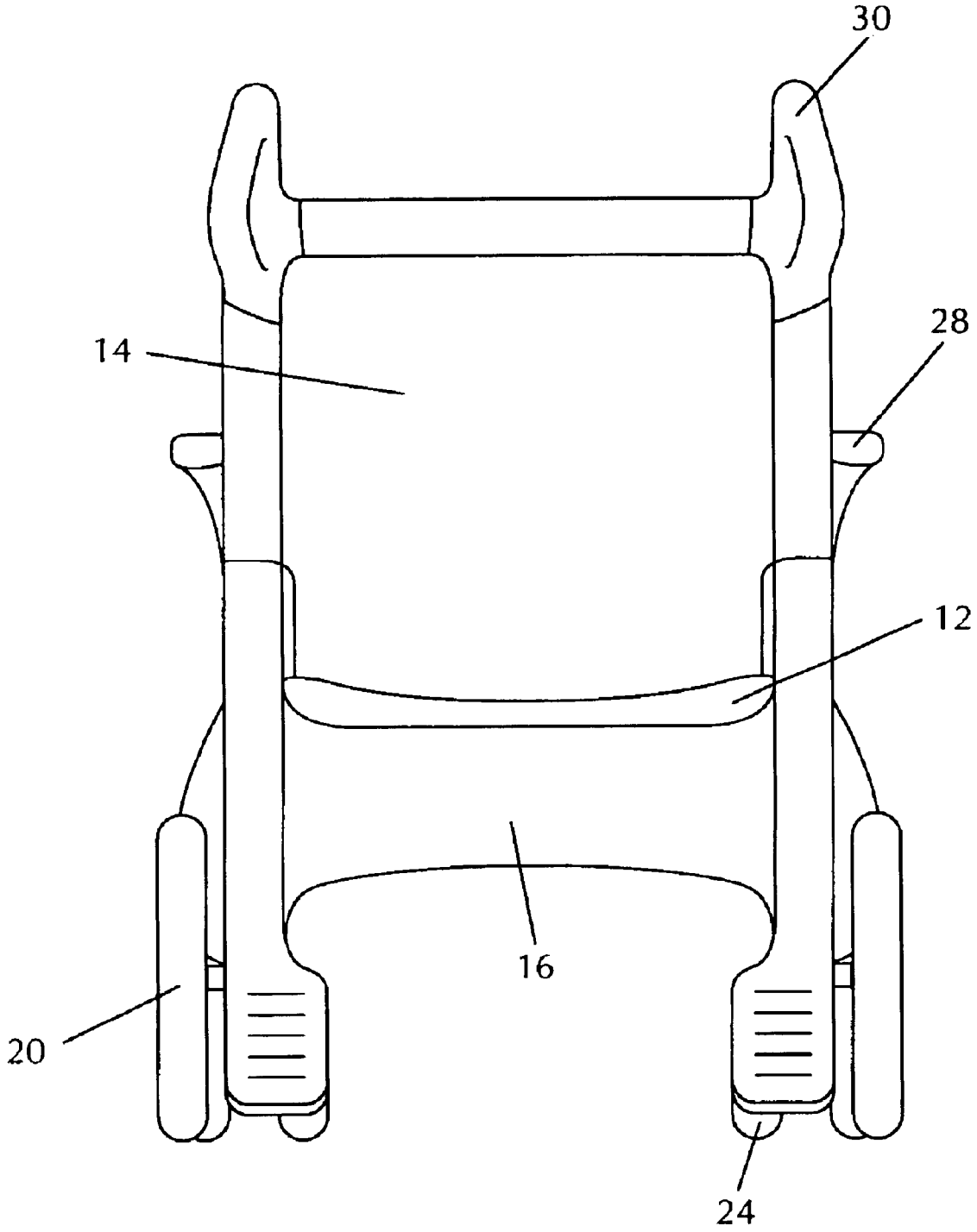
FIG. 4 is a rear view of the present invention, illustrating the principal components thereof.
Figure 5:
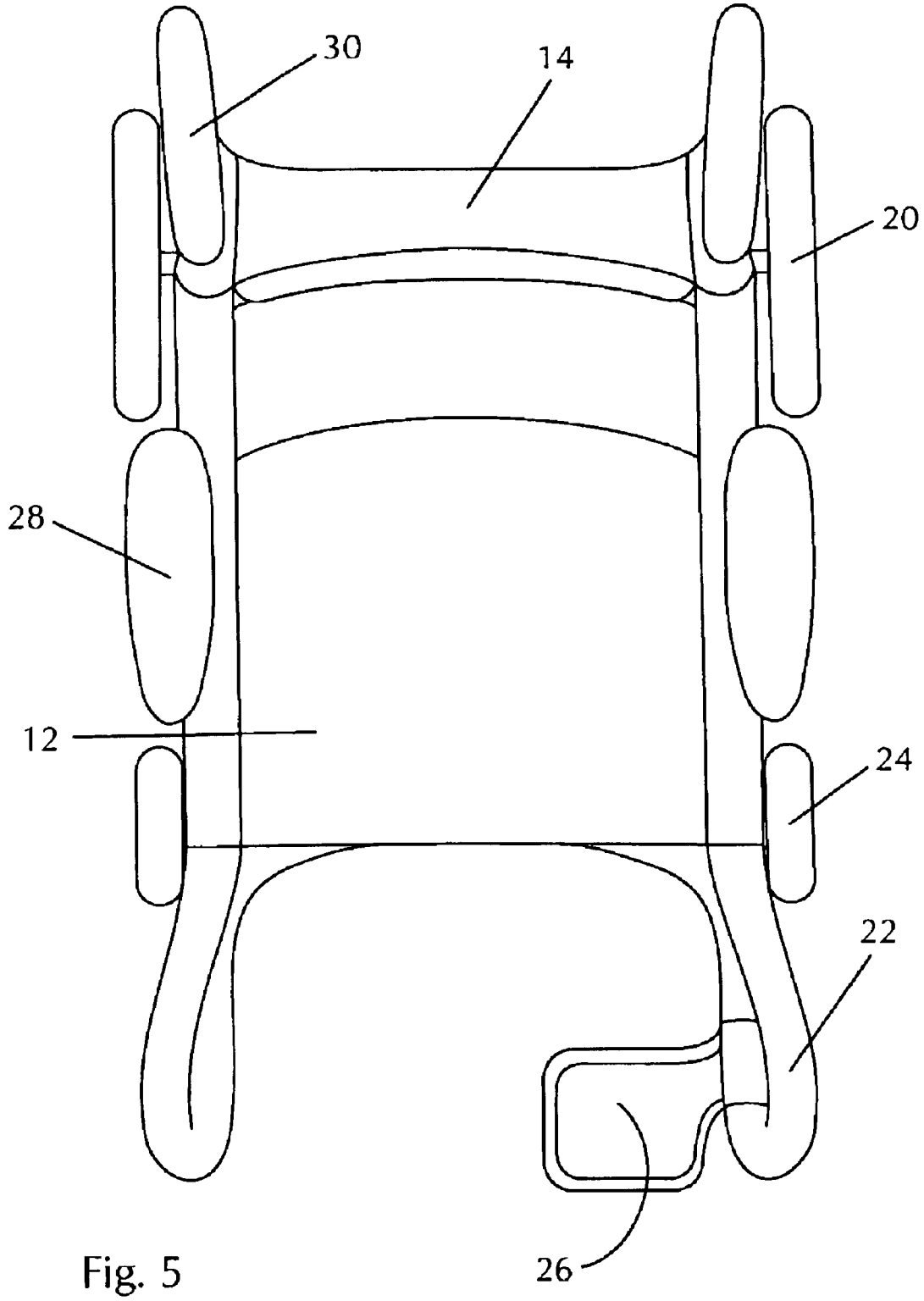
FIG. 5 is a top view of the present invention, including foot rest thereon.

As is the case with previously-existing wheelchairs, the device of the present invention utilizes removable left and/or right foot rests (26) for the comfort of the user. Such may be affixed to interior portions of the left and/or right front frame members (22). For the purposes of example, one such foot rest is shown in FIGS. 3 and 5, with both shown in FIGS. 1 and 6. The foot rests (26) may also comprise ears or extended members protruding outwardly therefrom. Such extended members function to prevent the foot rests (26) from rotating beyond a previously-determined point, for the purposes of stability and comfort. Importantly, the foot rests (26) further function as handles for lifting the wheelchair. Thus, in combination with the handles (30) located at the rear of the wheelchair, the foot rests (26) allow for convenient grasping and lifting of the wheelchair from multiple locations, greatly facilitating transport.

Furthermore, as is generally known in the art, the security wheelchair may include at least one removable tray (not illustrated in the FIGURES) for the convenience of the user, affixed to the wheelchair at a previously-determined location.

It is also important to note that the wheelchair of the present invention comprises no open cavities in which weapons or sharp objects may be placed. Such clearly enhances the value of the device from a security standpoint, in comparison to the standard metal wheelchairs of the prior art wherein numerous cavities are present.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. A security wheelchair (10) constructed of generally lightweight, non-metallic materials, comprising:

a frame (16) which comprises generally parallel left and right side horizontal members and a front support panel (18), with left and right front members (22) extending forwardly from the left and right side horizontal members and support panel (18), left and right upper vertical members extending upwardly from a rear portion of the left and right side horizontal members, the left and right upper vertical members comprising handles (30) thereon, left and right lower vertical members extending downwardly from a rear portion of the left and right side horizontal members, the left and right lower vertical members comprising brake levers on the sides thereof, lower portions of the left and right lower vertical members comprising rear wheel bearings (32) thereon, with left and right rear wheels mounted (20) thereto, the frame further comprising left and right arm rests (28) extending upwardly from a previously-determined location of the left and right horizontal members, a rigid, bucket seat affixed to the left and right side horizontal members of the frame, the seat comprising a bottom portion (12) and back portion (14), removable left and right foot rests (26) affixed to interior portions of the left and right front frame members (22);

the left and right front frame members (22) further comprising generally cylindrical sleeves (34) extending downwardly from front portions thereof, into which trucks (36) are inserted, with two left and two right front wheels (24) affixed to each truck (36), functioning to provide a non-collapsible wheelchair constructed of non-metallic components that may be passed through security systems and metal detection equipment without triggering same.

2. The security wheelchair as described in claim 1, wherein the wheelchair is constructed entirely of plastic components.

3. The security wheelchair as described in claim 1, wherein the wheelchair is symmetrical in configuration.

4. The security wheelchair as described in claim 1, wherein the left and right armrests extend upwardly from a rear portion of the left and right horizontal members of the frame.

5. The security wheelchair as described in claim 1, wherein the wheelchair comprises previously-determined colors, graphics, and indicia thereon.

6. The security wheelchair as described in claim 1, wherein the wheelchair comprises indicia in the form of corporate advertising thereon.

7. The security wheelchair as described in claim 1, wherein the left and right foot rests (26) further comprise extended members which function to prevent the foot rests (26) from rotating beyond a previously-determined point.

8. The security wheelchair as described in claim 1, wherein the left and right foot rests (26) further function as handles for lifting the wheelchair.

9. The security wheelchair as described in claim 1, wherein a seat cushion is removably attached to the seat of the wheelchair.

10. The security wheelchair as described in claim 1, wherein the handles further comprise a plurality of finger grips thereon.

11. The security wheelchair as described in claim 1, wherein the wheelchair comprises no open cavities in which weapons and objects may be placed.

12. A security wheelchair (10) constructed of generally lightweight, non-metallic materials, comprising:

a frame (16) which comprises generally parallel left and right side horizontal members and a front support panel (18), with left and right front members (22) extending forwardly from the left and right side horizontal members and support panel (18), left and right upper vertical members extending upwardly from a rear portion of the left and right side horizontal members, the left and right upper vertical members comprising handles (30) thereon, left and right lower vertical members extending downwardly from a rear portion of the left and right side horizontal members, the left and right lower vertical members comprising brake levers on the sides thereof, lower portions of the left and right lower vertical members comprising rear wheel bearings (32) thereon, with left and right rear wheels mounted (20) thereto, the frame further comprising left and right arm rests (28) extending upwardly from a previously-determined location of the left and right horizontal members, a sling seat affixed to the left and right side horizontal members of the frame, the left and right front frame members (22) further comprising generally cylindrical sleeves (34) extending downwardly from front portions thereof, into which trucks (36) are inserted, with two left and two right front wheels (24) affixed to each truck (36), functioning to provide a non-collapsible wheelchair constructed of non-metallic components that may be passed through security systems and metal detection equipment without triggering same.

* * * * *